US009327386B2

(12) United States Patent
Zhang et al.

(10) Patent No.: US 9,327,386 B2
(45) Date of Patent: May 3, 2016

(54) BENCH VICE

(71) Applicant: LAIZHOU HONGYUAN BENCH VICE MANUFACTURE CO., LTD., Laizhou, Shandong Province (CN)

(72) Inventors: Zhiquan Zhang, Laizhou (CN); Tao Wang, Laizhou (CN); Shujun Zhao, Laizhou (CN); Shousong Chen, Laizhou (CN); Xiaodong Wang, Laizhou (CN)

(73) Assignee: Laizhou Hongyuan Bench Vice Manufacture Co., Ltd., Laizhou, Shandong (CN)

( * ) Notice: Subject to any disclaimer, the term of this patent is extended or adjusted under 35 U.S.C. 154(b) by 110 days.

(21) Appl. No.: 14/372,984

(22) PCT Filed: Jan. 18, 2013

(86) PCT No.: PCT/CN2013/070648

§ 371 (c)(1),
(2) Date: Jul. 17, 2014

(87) PCT Pub. No.: WO2014/063450

PCT Pub. Date: May 1, 2014

(65) Prior Publication Data

US 2014/0361479 A1 Dec. 11, 2014

(30) Foreign Application Priority Data

Oct. 22, 2012 (CN) ..... 2012 1 0401379

(51) Int. Cl.
*B25B 1/12* (2006.01)
*B25B 1/10* (2006.01)

(52) U.S. Cl.
CPC . *B25B 1/103* (2013.01); *B25B 1/12* (2013.01); *B25B 1/125* (2013.01)

(58) Field of Classification Search
CPC ..... B25B 1/12; B25B 1/103; B25B 1/125
See application file for complete search history.

(56) References Cited

U.S. PATENT DOCUMENTS 1,391,913 A * 9/1921 Smith ..... B25B 1/125 269/177
2,102,602 A * 12/1937 Nash ..... B25B 1/125 269/179
3,806,107 A * 4/1974 Pitzer ..... B25B 1/12 269/188

(Continued)

FOREIGN PATENT DOCUMENTS

CN 2033325 U 3/1989
CN 2059120 U 7/1990

(Continued)

*Primary Examiner* — Lee D Wilson
*Assistant Examiner* — Tyrone V Hall, Jr.
(74) *Attorney, Agent, or Firm* — Andrew W. Chu; Craft Chu PLLC

(57) ABSTRACT

A bench vice includes a fixed vice body, a movable vice body, a screw rod, a screw nut, a quick-action mechanism, and an operating handle. The quick-action mechanism controls the screw rod and screw nut to engage or disengage so as to move slowly or quickly. The operating handle operates the quick-action mechanism. The movable vice body is assembled with the screw rod into an assembly, and both the quick-action mechanism and the operating handle are arranged on the front end of the fixed vice body. Since the quick-action mechanism and the operating handle are arranged on the front end of the fixed vice body, the operator can operate more conveniently, and thereby the working efficiency is improved.

5 Claims, 6 Drawing Sheets

(56) References Cited

U.S. PATENT DOCUMENTS

| | | | | | |
|---|---|---|---|---|---|
| 5,489,090 | A * | 2/1996 | Leger | B25B 1/2452 | 269/158 |
| 7,036,807 | B1 * | 5/2006 | Gasparyan | B25B 1/125 | 269/181 |
| 2008/0029947 | A1 * | 2/2008 | Meholovitch | B25B 1/125 | 269/181 |

FOREIGN PATENT DOCUMENTS

| | | | | |
|---|---|---|---|---|
| CN | 102267109 | A | 12/2011 | |
| CN | 202491188 | U | 10/2012 | |
| CN | 202846390 | U | 4/2013 | |
| GB | 349249 | A * | 5/1931 | B25B 1/125 |
| GB | 721589 | A | 1/1955 | |

* cited by examiner

BENCH VICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a mechanical processing device, in particular to a bench vice.

2. Description of Related Art Including Information Disclosed Under 37 CFR 1.97 and 37 CFR 1.98

A bench vice is a clamping tool used by a bench worker, and is designed to clamp and hold a work piece. A conventional bench vices usually comprises five major parts: a movable vice body, a fixed vice body, a screw rod, a screw nut, and a base, in the following structure: the fixed vice body is mounted on the base, and is assembled with the screw nut into an assembly, i.e., the two components can't move in relation to each other. The movable vice body is assembled with the screw rod into an assembly, and a handle is mounted on the outer end of the screw rod that is in thread engagement with the screw nut; the movable vice body runs across the cavity in the upper part of the fixed vice body and can move in the cavity. If the fixed vice body is capable of revolving on the base to change its working position, a screw designed to lock the fixed vice body in position must be arranged on the base. In use, the screw rod that is engaged with the screw nut is turned so that the movable vice body and the fixed vice body displace in relation to each other, to attain the purpose of clamping up or releasing the work piece.

A drawback of such a bench vice is: the rotating screw rod can only drive the movable vice body to move slowly, and thereby can only achieve slow clamping and releasing of the work piece. Especially, for a bench vice that has a wide adjustment range of the vice jaw and involves frequent work piece change, to create a large relative displacement between the movable vice body and the fixed vice body, the screw rod has to be turned frequently and for a long time; consequently, the heavy bench work will be more awkward, the labor intensity is increased, and the working efficiency is decreased.

The structural principle of existing quick-action bench vices usually utilizes disengagement of the screw nut from the screw rod to attain the purpose of quick action. However, the existing operating handle (i.e., a handle designed to manipulate the screw rod and the screw nut to engage or disengage) is usually mounted on the base or middle or rear part of the fixed vice body; thus, when the bench worker operates the bench vice, his arms have to move in a long range, which is very inconvenient.

SUMMARY OF THE INVENTION

The technical problem to be solved in the present invention is to provide a bench vice, with which the bench worker can operate more conveniently.

The present invention employs the following technical scheme to solve the technical problem: a bench vice, comprising a fixed vice body, a movable vice body, a screw rod, a screw nut, a quick-action mechanism designed to control the screw rod and screw nut to engage or disengage so as to move slowly or quickly, and an operating handle designed to operate the quick-action mechanism, wherein, the movable vice body is assembled with the screw rod into an assembly, and both the quick-action mechanism and the operating handle are arranged on the front end of the fixed vice body.

The beneficial effects of the present invention include: since the operating handle and the quick-action mechanism are arranged on the front end of the fixed vice body, the mechanical processing worker doesn't have to move his/her arms in a long range, and thereby the operation is more convenient; in addition, the bench vice can be manufactured more conveniently since the quick-action mechanism is arranged on the front end of the fixed vice body.

On the basis of the technical scheme described above, the present invention can be further improved as follows:

Moreover, the quick-action mechanism is implemented as follows: a screw nut slot is arranged on the front end of the fixed vice body below the screw rod, the screw nut is accommodated in the screw nut slot, and comprises a screw nut body at the upper end and a screw nut holder at the lower end, the upper end of the screw nut body has an arc groove in the extension direction of the screw rod, and the arc groove has threads on its bottom to engage with the screw rod, a first spring is fitted over the outer wall of the screw nut holder, the screw nut slot communicates with a first thread hole below it, a thread bushing is screwed in the first thread hole, the lower end of the first spring is fixed to the thread bushing, the screw nut holder runs through a central hole of the thread bushing, and has an open slot on its bottom surface, the open slot has a pin hole, the upper end of a connecting plate is inserted in the open slot and is fixed by a pin that runs through the pin hole, the lower end of the connecting plate has a slot, an eccentric shaft is mounted in the slot, and is connected with the operating handle; an annular V-groove is arranged in the circumferential direction on the lateral surface of the eccentric shaft, a pair of blind holes are arranged in a splayed shape in the V-groove, a stop pin is fixed in each of the blind holes, a steel ball butts against the opening of the V-groove, and the steel ball is fixed via a second spring to the front end of the fixed vice body. The beneficial effects of the above scheme include: with the eccentric shaft structure, the operating handle can drive the screw nut holder to act, and thereby the screw rod and the screw nut can engage/disengage; in addition, the eccentric shaft has a positioning means; thus, the overall connection and driving of the system is very stably and reliable, and the system has a long service life.

Furthermore, the quick-action mechanism is implemented as follows: a screw nut slot is arranged on the front end of the fixed vice body at the side of the screw rod, the screw nut is accommodated in the screw nut slot, and comprises a screw nut body near the screw rod and a screw nut holder away from the screw rod, the screw nut body has an arc groove in the extension direction of the screw rod on its end near the screw rod, and the arc groove has threads on its bottom to engage with the screw rod, a first spring is fitted over the outer wall of the screw nut holder, the screw nut slot communicates with a first thread hole at its end away from the screw rod, a thread bushing is screwed in the first thread hole, the end of the first spring away from the screw rod is fixed in position by the thread bushing, the screw nut holder runs through a central hole of the thread bushing, the end of the screw nut holder away from the screw rod is hinged via a pin shaft to the operating handle, and the distance from the hinge point to the edge of the operating handle at the end near the screw nut holder is not equal to the distance from the hinge point to the edge at one side of the operating handle. The beneficial effects of the above scheme include: with the structure in which the distances from the operating handle to the hinge point in two directions are not equal to each other, the operating handle can drive the screw nut holder to act, and thereby the screw rod and the screw nut can engage/disengage; an advantage of the scheme is that the structure of the quick-action mechanism is very simple, but the connection and action are not as stable as those in the first embodiment.

Furthermore, the quick-action mechanism is implemented as follows: a screw nut slot is arranged on the front end of the fixed vice body below the screw rod, the screw nut is accommodated in the screw nut slot, and comprises a screw nut body at the upper end and a screw nut holder at the lower end, the upper end of the screw nut body has an arc groove in the extension direction of the screw rod, and the arc groove has threads on its bottom to engage with the screw rod, a first spring is fitted over the outer wall of the screw nut holder, the screw nut slot communicates with a first thread hole below it, a thread bushing is screwed in the first thread hole, the lower end of the first spring is fixed to the thread bushing, the screw nut holder runs through a central hole of the thread bushing, and has a second thread hole extending upwards on its bottom surface, a screw is arranged in the second thread hole and is engaged with the inside threads of the second thread hole, the nut of the screw is connected with the operating handle, the operating handle is arranged on a horizontal rail and can rotate on the rail, and at least a part of the rail surface of the rail have a convex part. The beneficial effects of the above scheme include: since the operating handle is on the rail, the operating handle will be at a higher position or lower position as the rail surface fluctuates; thus, the operating handle can drive the screw nut holder to act, and thereby the screw rod and the screw nut can engage/disengage; such a structure is simpler than the structure in the first embodiment, and the fixing and connection are better than those in the second embodiment.

Furthermore, the quick-action mechanism is implemented as follows: a screw nut slot is arranged on the front end of the fixed vice body below the screw rod, the screw nut is accommodated in the screw nut slot, and comprises a screw nut body at the upper end and a screw nut holder at the lower end, the upper end of the screw nut body has an arc groove in the extension direction of the screw rod, and the arc groove has threads on its bottom to engage with the screw rod, a first spring is fitted over the outer wall of the screw nut holder, the screw nut slot communicates with a first thread hole below it, a thread bushing is screwed in the first thread hole, the lower end of the first spring is fixed to the thread bushing, the screw nut holder runs through a central hole of the thread bushing, and has a second thread hole extending upwards on its bottom surface, a screw is arranged in the second thread hole and is engaged with the inside threads of the second thread hole, the nut of the screw is connected with the operating handle via a lever, and each end of the lever acts in the vertical direction. The beneficial effects of the above scheme include: with lever principle, the operating handle drives the screw nut holder to act, and thereby the screw rod and the screw nut can engage/disengage; the advantages of this scheme include: this embodiment is simpler than embodiment 3, the structure is simpler, and the operation is more labor-saving.

Among the figures, the components denoted by the symbols are listed as follows:

1—fixed vice body, 101—front end of fixed vice body, 102—middle part of bench vice, 103—tail part of bench vice, 2—movable vice body, 3—screw rod, 4—screw nut, 401—screw nut body, 402—screw nut holder, 403—open slot, 404—pin, 5—quick-action mechanism, 6—operating handle, 7—screw nut slot, 8—arc groove, 9—first spring, 10—first thread hole, 11—thread bushing;

201—connecting plate, 202—slot, 203—eccentric shaft, 204—V-groove, 205—stop pin, 206—steel ball, 207—second spring, 208—set screw, 209—pin shaft, 210—step screw, 211—washer, 212—shaft.

DETAILED DESCRIPTION OF THE DRAWINGS

Hereunder the principle and characteristics of the present invention will be detailed with reference to the accompanying drawings. However, it should be noted that the embodiments are provided only to interpret the present invention, and don't constitute any limitation to the scope of the present invention.

Figure 1:
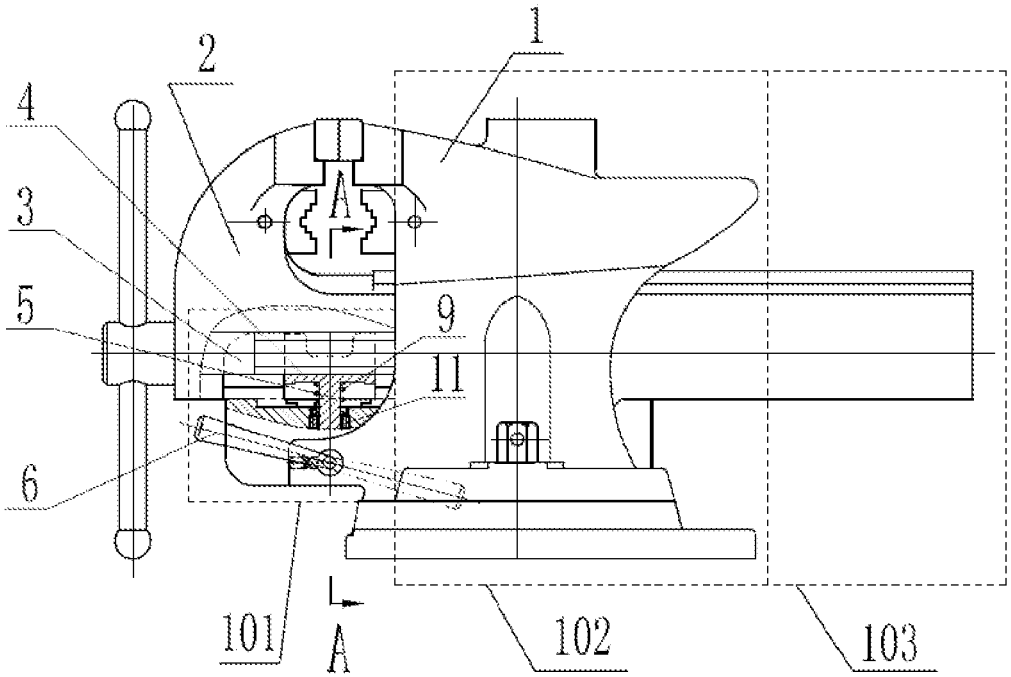
FIG. 1 is a schematic view of an overall structural diagram of embodiment 1 of the present invention.

As shown in FIG. 1, a bench vice is provided in the present invention, comprising a fixed vice body 1, a movable vice body 2, a screw rod 3, a screw nut 4, a quick-action mechanism 5 designed to control the screw rod 3 and screw nut 4 to engage or disengage so as to act slowly or quickly, and an operating handle 6 designed to operate the quick-action mechanism 5, wherein, the movable vice body 2 is assembled with the screw rod 3 into an assembly, and both the quick-action mechanism 5 and the operating handle 6 are arranged on the front end 101 of the fixed vice body.

Bench vices usually employ a working principle of engagement/disengagement between screw rod and screw nut to implement switchover between slow action and quick action, with the only difference in the structure of the quick-action mechanism 5. For the present invention, since the quick-action mechanism 5 and operating handle 6 in existing bench vices are usually arranged on the base or middle or rear part of the bench vice but the clamped work piece is at the movable vice body at the front end of the bench vice, the bench worker has to move his/her arms in a long range during switchover of slow action/quick action; therefore, the operation is very inconvenient.

The first inventive step of the present invention is to arrange both the quick-action mechanism 5 and the operating handle 6 on the front end 101 of the fixed vice body, so that the operator can operate more conveniently and the working efficiency can be improved; in other words, an inventive aspect to be protected is that the quick-action mechanism 5 and the operating handle 6 are arranged in the area of the described position. In addition, it should be noted that the terms "front end" and "rear end" mentioned here are described in relation to the movable vice body of the bench vice. Those skilled in the art usually refer one end of the movable vice body that faces outwards and is used to hold the work piece as "front end", and refer the other end as "tail end" or "rear end". Moreover, though the "front end of fixed vice body" may not be clear to non-specialized persons, it is a conventional term in the art to bench vice manufacturers, i.e., it is the part that protrudes from the front end below the fixed vice body.

As shown in FIG. 1, the three dotted boxes represent the front end 101 of fixed vice body, middle part 102 of bench vice, and rail part 103 of bench vice, respectively. The fixed vice body in the middle part 102 of bench vice is a part that doesn't protrude forward. The area of the "front end 101 of fixed vice body" mentioned here can be determined clearly and directly from the appearance, and is clear and deterministic on any bench vice, because the front end 101 of fixed vice body is on the bottom part of the fixed vice body and only that part protrudes forward in the production process. Reflected in the appearance, the protruding bottom part is the "front end of fixed vice body" often said by those skilled in the art. Certainly there is a boundary line between the protruding bottom part of the bench vice and the non-protruding part of the bench vice body (i.e., middle part 102 of bench vice), and the fixed vice body part that protrudes from the boundary line is the front end of fixed vice body referred in this document. That feature is reflected clearly in photographs. In view of the requirement for the format of the drawings, no photograph is attached. The applicant can provide photographs whenever required in the subsequent procedure to demonstrate that the protrusion range can be determined directly, clearly, and undoubtedly from the appearance.

In addition, on that basis, another inventive step of the present invention is: several embodiments are provided hereunder, and these embodiments have different manipulating structures, wherein, some are more reasonable in design, and others are more labor-saving, but all of them can be used to attain the object of the present invention. These embodiments are detailed as follows:

Embodiment 1

As shown in FIG. 1-5, the quick-action mechanism 5 is implemented as follows: a screw nut slot 7 is arranged on the front end of the fixed vice body below the screw rod 3, the screw nut 4 is accommodated in the screw nut slot 7, and comprises a screw nut body 401 at the upper end and a screw nut holder 402 at the lower end, the upper end of the screw nut body 401 has an arc groove 8 in the extension direction of the screw rod 3, and the arc groove 8 has threads on its bottom to engage with the screw rod 3, a first spring 9 is fitted over the outer wall of the screw nut holder 402, the screw nut slot 7 communicates with a first thread hole 10 below it, a thread bushing 11 is screwed in the first thread hole 10, the lower end of the first spring 9 is fixed to the thread bushing 11, the screw nut holder 402 runs through a central hole of the thread bushing 11, and has an open slot 403 on its bottom surface, the open slot 403 has a pin hole, the upper end of a connecting plate 201 is inserted in the open slot 403 and is fixed by a pin 404 that runs through the pin hole, the lower end of the connecting plate has a slot 202, an eccentric shaft 203 is mounted in the slot 202, and is connected with the operating handle 6, preferably the eccentric shaft 203 and the operating handle 6 are in an integral structure or formed integrally;

an annular V-groove 204 is arranged in the circumferential direction on the lateral surface of the eccentric shaft 203, a pair of blind holes are arranged in a splayed shape in the V-groove 204, a stop pin 205 is fixed in each of the blind holes, a steel ball 206 butts against the opening of the V-groove 204, and the steel ball 206 is fixed via a second spring 207 to the front end of the fixed vice body.

Here, it should be noted: first, the arc groove 8 is named as "arc groove" only to differentiate from the names of other grooves, but actually is not limited to arc groove, which is to say, the arc groove 8 can be in any other shape, as long as the screw rod 3 can be accommodated in the arc groove 8 on the upper end of the screw nut body 401 and the screw rod 3 can be engaged with the threads on the lower part of the arc groove 8. Of course, alternatively, threads that are designed to engage with the screw rod 3 can be arranged on the perimeter of the screw nut body 401, and the screw rod 3 and the screw nut 4 can be controlled to engage or disengage by changing the position of the screw nut with the structure described below.

Second, a first spring 9 is fitted over the outer wall of the screw nut holder 402, the lower end of the first spring 9 is fixed to the thread bushing 11, and the upper end of the first spring 9 preferably butts against the bottom surface of the screw nut body 401, mainly for the following purposes: 1) ensure the threads of the screw nut can be engaged with the threads of the screw rods reliably and the structure can withstand high clamping force; 2) when the bench vice is opened by slow action, the supporting screw nut will not slide down and disengage from the screw rod; and, 3) ensure the pushing force is moderate when quick advance function is used in thread engagement state.

Third, the slot 202 is designed to ensure an effective travel distance required for the screw nut to disengage from the threads of the screw rod when the screw nut and the screw rod are in thread engagement state and advance quickly.

Figure 2:
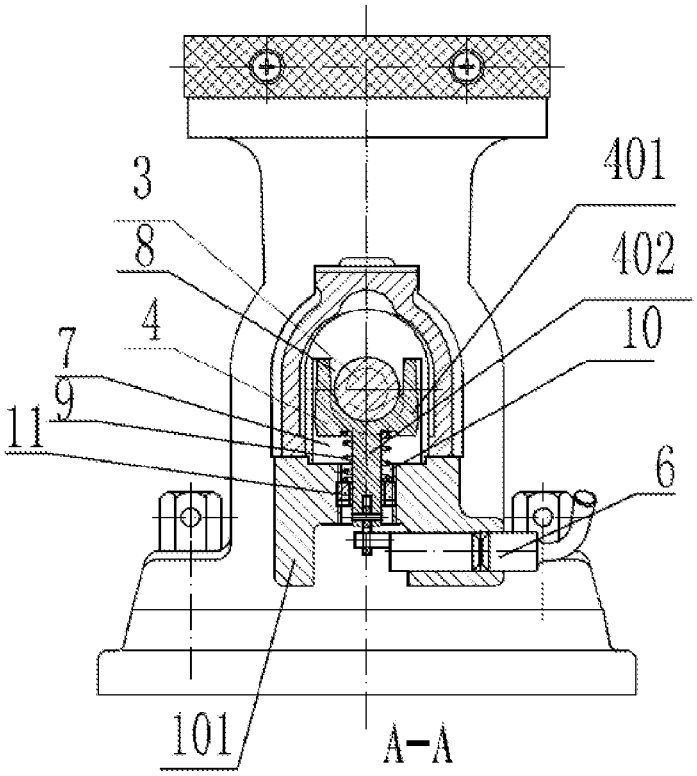
FIG. 2 is a sectional view across line A-A of the structure shown in FIG. 1.
Figure 3:
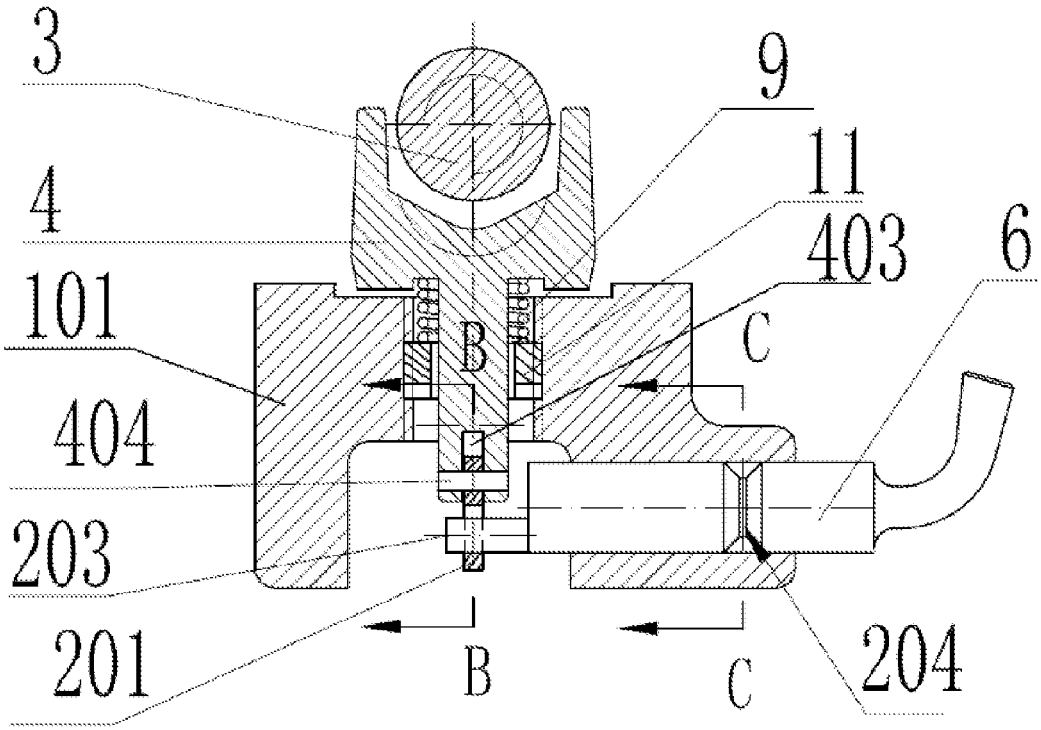
FIG. 3 is a partially enlarged view of the structure shown in FIG. 2.
Figure 4:
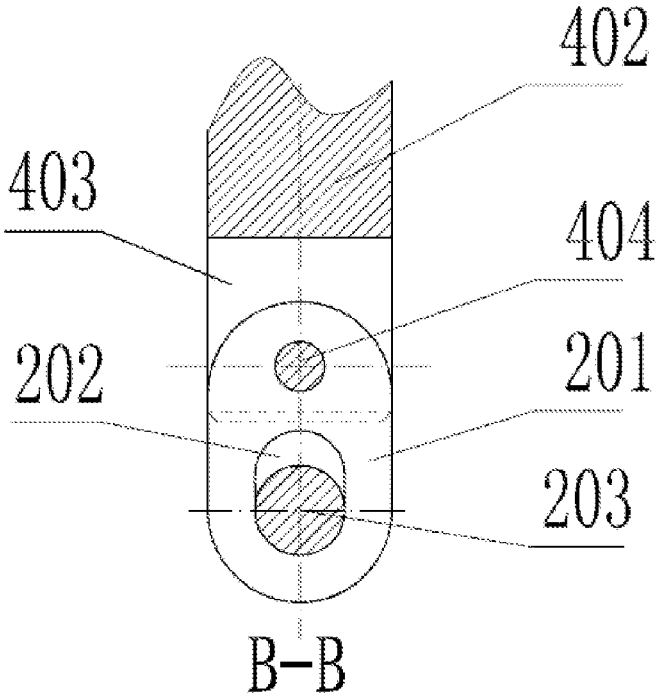
FIG. 4 is a sectional view across line B-B of the structure shown in FIG. 3.
Figure 5:
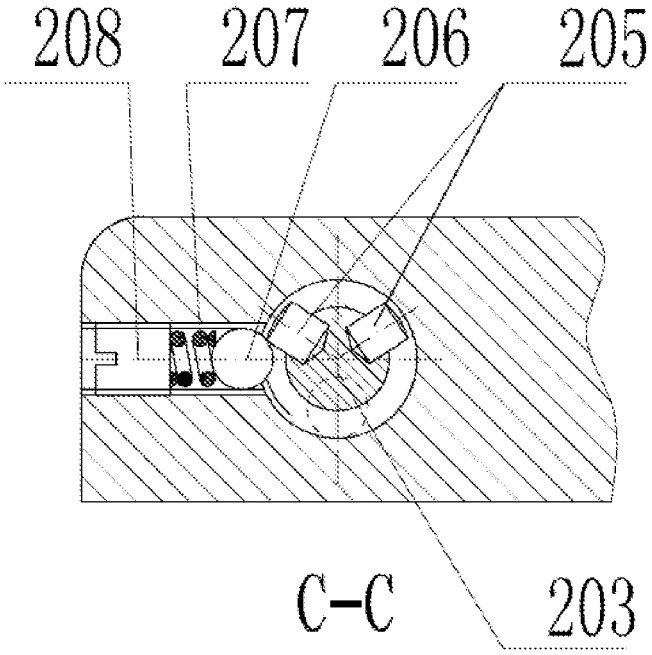
FIG. 5 is a sectional view across line C-C of the structure shown in FIG. 3.

Fourth, those skilled in the art can appreciate that the eccentric shaft turning structure can be implemented in a variety of ways; usually, that structure is implemented by a turning means, for example, the sectional structure shown in FIG. 2, i.e., the eccentric shaft is arranged on the rim of a revolving circle. Particularly, it should be noted the structure of steel ball 206 and spring 207 is mainly designed for the following purpose: one end of the second spring 207 butts against the V-groove 204 from a side via the steel ball 206, the steel ball 206 takes a positioning effect to position the operating handle 6 in the mounting position accurately, and the stop pin 205 is used to confine the position of the operating handle 6 in quick action/slow action. In addition, the other end of the second spring 207 can be fixed to a set screw 208, so that the purpose of regulating the pre-tightening force of the steel ball 206 against the V-groove can be attained by tightening or loosening the set screw 208.

When the operating handle 6 is pulled, the position of the eccentric shaft 203 in the slot will be changed under the driving action of the operating handle 6; the eccentric shaft 203 doesn't drive the screw nut holder 402 to move upwards directly when the eccentric shaft 203 moves upwards; instead, the screw nut holder 402 moves upwards together with the connecting plate 201 because they are driven by the screw nut body 401 under the spring force of the first spring 9; the only purpose of the position change of the eccentric shaft in the slot is to make room for the screw nut holder 402 to move upwards, and, as the screw nut holder 402 moves upwards, the screw nut 4 and the screw rod 3 will engage with each other, and thus slow action will be realized; on the other hand, when the screw nut holder 402 moves downwards under the driving action of the eccentric shaft 203, the screw rod 3 and the screw nut 4 will disengage from each other, and thus quick action will be realized.

Embodiment 2

Figure 6:
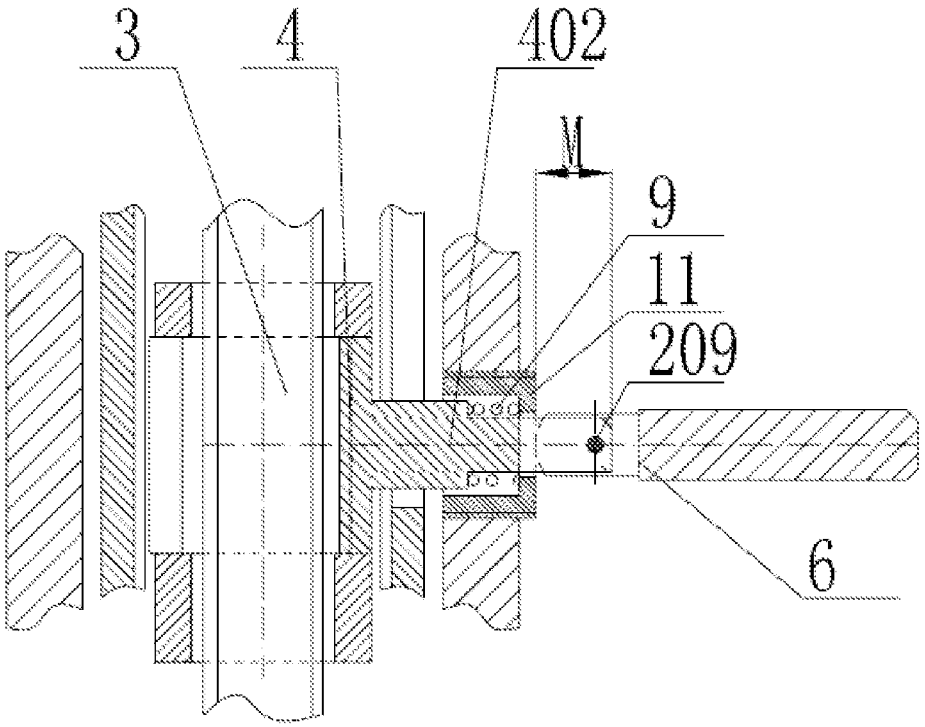
FIG. 6 is a schematic view of a diagram of a second embodiment 2 of the present invention in a quick-action position.
Figure 7:
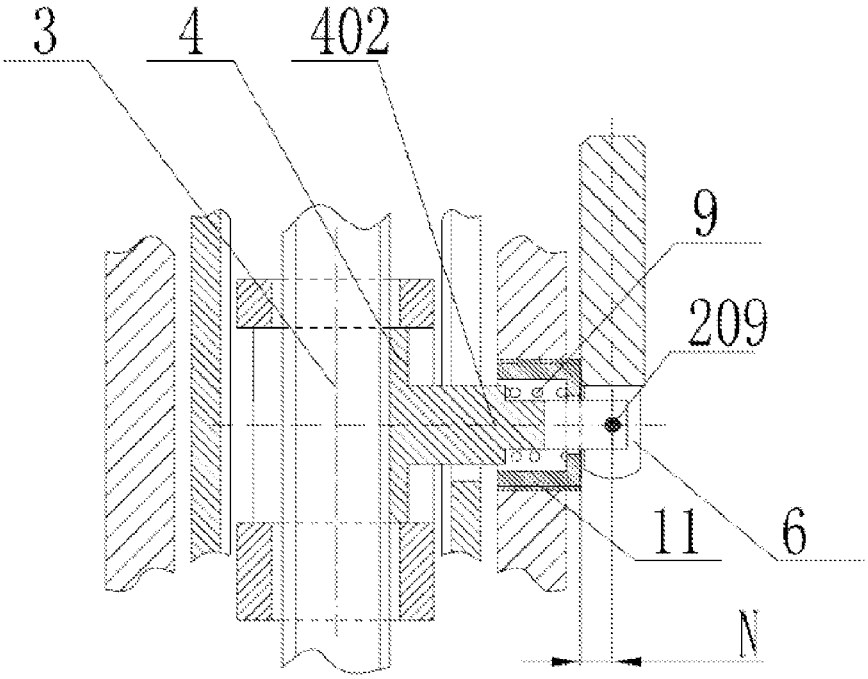
FIG. 7 is a schematic view of a diagram of the second embodiment 2 of the present invention in a slow-action position.

As shown in FIG. 6 and FIG. 7, the quick-action mechanism 5 is implemented as follows: a screw nut slot 7 is arranged on the front end of the fixed vice body at the side of the screw rod 3, the screw nut 4 is accommodated in the screw nut slot 7, and comprises a screw nut body 401 near the screw rod 3 and a screw nut holder 402 away from the screw rod 3, the screw nut body 401 has an arc groove 8 in the extension direction of the screw rod 3 on its end near the screw rod 3, and the arc groove 8 has threads on its bottom to engage with the screw rod 3, a first spring 9 is fitted over the outer wall of the screw nut holder 402, the screw nut slot 7 communicates with a first thread hole 10 at its end away from the screw rod 3, a thread bushing 11 is screwed in the first thread hole 10, the end of the first spring 9 away from the screw rod 3 is fixed in position by the thread bushing 11, the screw nut holder 402 runs through a central hole of the thread bushing 11, the end of the screw nut holder 402 away from the screw rod 3 is hinged via a pin shaft 209 to the operating handle 6, and the distance from the hinge point to the edge of the operating handle 6 at the end near the screw nut holder is not equal to the distance from the hinge point to the edge at one side of the operating handle 6.

Compared with embodiment 1, the differences lie in: first, the quick-action mechanism 5 is not arranged below the screw rod 3, but is arranged at a side of the screw rod 3; second, the screw nut holder 402 is directly hinged to the operating handle 6 via the pin shaft 209, and the position of the hinge point is arranged in a way that the distance from the pin shaft 209 to a side is not equal to the distance from the pin shaft 209 to an end, i.e., 'm' is not equal to 'n' in FIG. 6 and FIG. 7; in that way, when the operating handle 6 is pulled, the screw nut holder 402 will move to a different position since 'm' is not equal to 'n', and thus the purpose of engagement/disengagement between the screw rod 3 and the screw nut 4 is attained.

Embodiment 3

Figure 8:
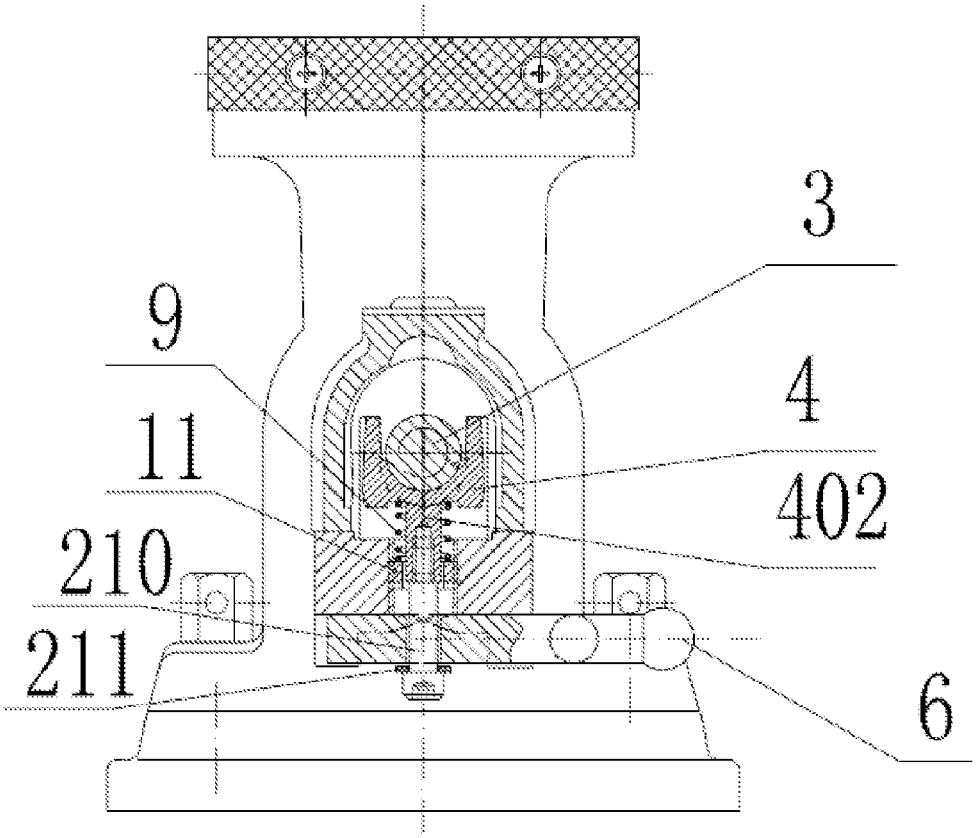
FIG. 8 is another schematic view of an overall structural diagram of a third embodiment 3 of the present invention.
Figure 9:
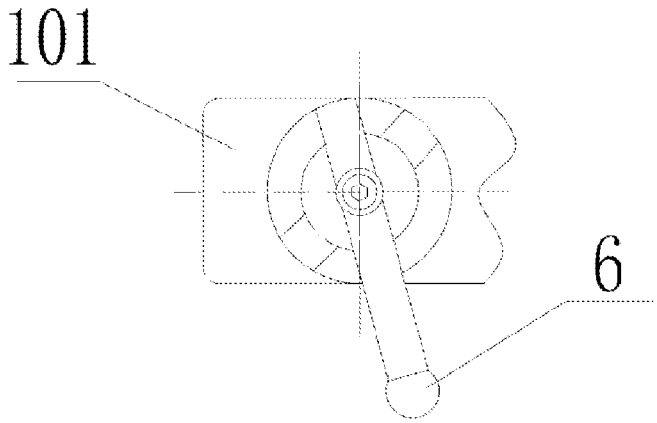
FIG. 9 is a bottom elevation view of the structure shown in FIG. 8.
Figure 10:
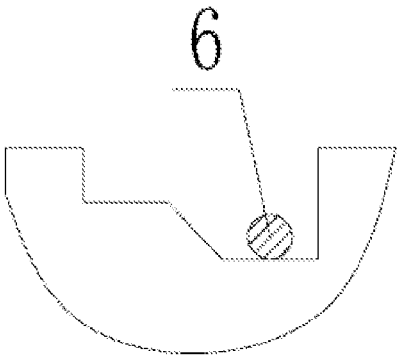
FIG. 10 is a side sectional view of the structure shown in FIG. 9.

As shown in FIGS. 8, 9, and 10, the quick-action mechanism 5 is implemented as follows: a screw nut slot 7 is arranged on the front end of the fixed vice body below the screw rod 3, the screw nut 4 is accommodated in the screw nut slot 7, and comprises a screw nut body 401 at the upper end and a screw nut holder 402 at the lower end, the upper end of the screw nut body 401 has an arc groove 8 in the extension direction of the screw rod, and the arc groove 8 has threads on its bottom to engage with the screw rod 3, a first spring 9 is fitted over the outer wall of the screw nut holder 402, the screw nut slot 7 communicates with a first thread hole 10 below it, a thread bushing 11 is screwed in the first thread hole 10, the lower end of the first spring 9 is fixed to the thread bushing 11, the screw nut holder 402 runs through a central hole of the thread bushing 11, and has a second thread hole extending upwards on its bottom surface, a screw is arranged in the second thread hole and is engaged with the inside threads of the second thread hole, the nut of the screw is connected with the operating handle, the operating handle is arranged on a horizontal rail and can rotate on the rail, and at least a part of the rail surface of the rail have a convex part.

Compared with embodiment 1, the similarity is that the quick-action mechanism 5 is also arranged below the screw rod 3, and the difference lies in the final part that is connected with the operating handle, i.e., a screw is arranged on the bottom of the screw nut holder 402 and is screwed into the screw nut holder 402 in bottom-top direction; for accurate positioning, a step screw 210 can be used, and the nut of the step screw 210 is fixed in the middle part of the operating handle; the operating lever at the ends of the operating handle is laid on a rail, which has an undulate surface and is preferably an annular rail. The arrangement on the rail is shown in detail in FIG. 10, i.e., the rail has at least two different heights, and the higher point and lower point of the rail surface preferably transit smoothly. A washer 211 is arranged on the bottom part of the step screw 210. When the operating lever is turned, the operating handle 6 will move to different heights since the rail has a convex part, or, in other words, the rail surface is undulate; accordingly, the nut of the step screw 210 in the middle part will be in a higher position or lower position; thus, the screw nut holder 402 is driven to transit to different heights, and the screw rod 3 and the screw nut 4 are controlled to engage/disengage.

Of course, alternatively, the lower end of the screw nut holder 402 can be directly fixed to the operating handle 6; in that case, a step screw 210 is required, and the screw nut holder 402 is driven by the nut of the step screw 210. With such an arrangement, the fixing effect is better.

Embodiment 4

Figure 11:
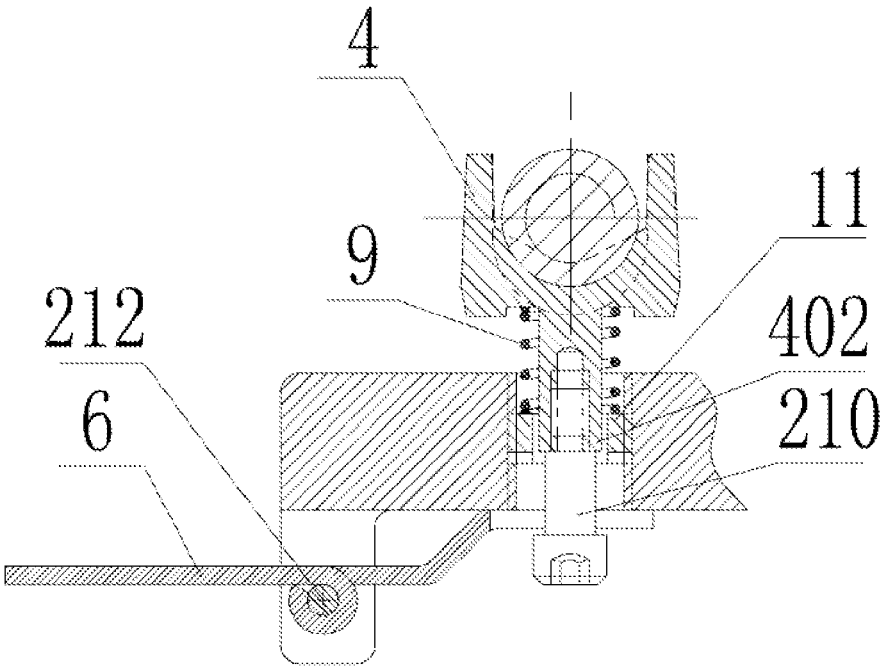
FIG. 11 is a schematic view of a diagram of a fourth embodiment 4 of the present invention in a slow-action position.
Figure 12:
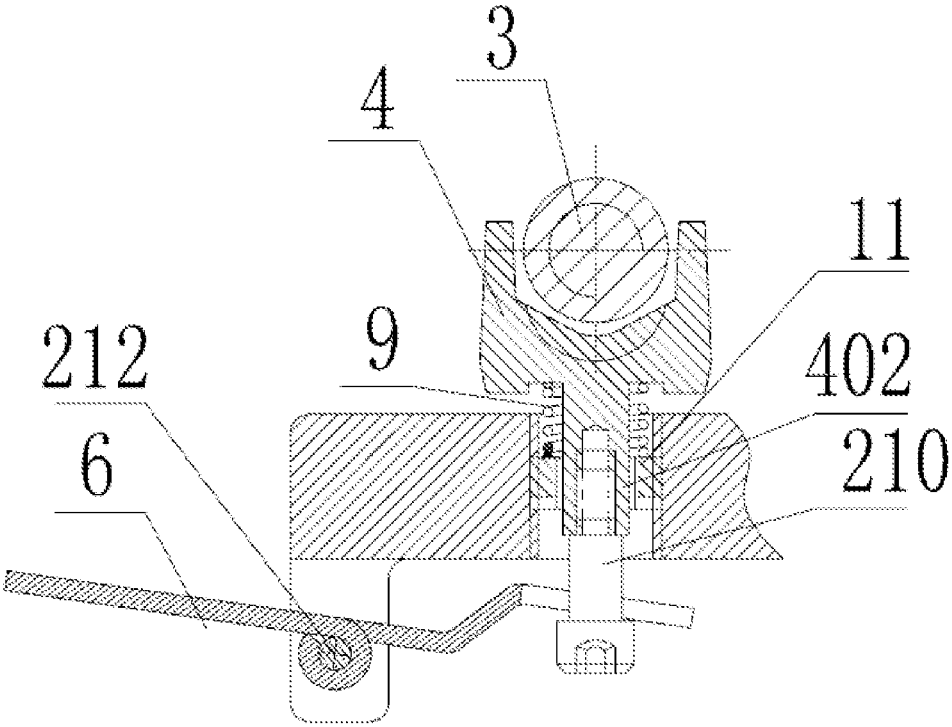
FIG. 12 is a schematic view of a diagram of the fourth embodiment 4 of the present invention in a quick-action position.

As shown in FIG. 11 and FIG. 12, the quick-action mechanism 5 is implemented as follows: a screw nut slot 7 is arranged on the front end of the fixed vice body below the screw rod 3, the screw nut 4 is accommodated in the screw nut slot 7, and comprises a screw nut body 401 at the upper end and a screw nut holder 402 at the lower end, the upper end of the screw nut body 401 has an arc groove 8 in the extension direction of the screw rod, and the arc groove 8 has threads on its bottom to engage with the screw rod 3, a first spring is fitted over the outer wall of the screw nut holder, the screw nut slot communicates with a first thread hole below it, a thread bushing is screwed in the first thread hole, the lower end of the first spring is fixed to the thread bushing, the screw nut holder runs through a central hole of the thread bushing, and has a second thread hole extending upwards on its bottom surface, a screw is arranged in the second thread hole and is engaged with the inside threads of the second thread hole, the nut of the screw is connected with the operating handle via a lever, and each end of the lever acts in the vertical direction.

Compared with embodiment 3, the difference lies in: the nut of the step screw 210 is fixed to one end of the lever, and the other end of the lever is connected with the operating handle 6. The lever can enclose the operating handle 6 into an operating handle that rotates around a shaft 212; thus, when the operating handle 6 is pushed, the nut of the screw will move up and down accordingly via the lever, and thereby the screw nut holder 402 will move up and down and the screw rod 3 and the screw nut 4 will engage with each other.

In the embodiments described above, the exact positions of the screw nut holder 402 in the higher position and lower position shall be determined reasonably according to the relative travel length between the screw rod and the screw nut. Of course, those skilled in the art can take that into account naturally in advance when they design such a bench vice.

While the present invention is described above in some preferred embodiments, the present invention is not limited to those preferred embodiments. Any modification, equivalent replacement, and improvement made without departing from the spirit and principle of the present invention shall be deemed as falling into the protected domain of the present invention.

We claim:

1. A bench vice, comprising a fixed vice body, a movable vice body, a screw rod, a screw nut, a means for controlling said screw rod and said screw nut, and an operating handle engaging said means for controlling, wherein said movable vice body is assembled with said screw rod into an assembly, and said means for controlling and said operating handle are arranged on a front end of said fixed vice body.

2. The bench vice according to claim 1, wherein said means for controlling comprises:

a screw nut slot arranged on said front end of said fixed vice body below said screw rod, said screw nut being accommodated in said screw nut slot;

a screw nut body at an upper end of said screw nut slot;

a screw nut holder at a lower end of said screw nut slot, said upper end of the screw nut body having an arc groove in an extension direction of said screw rod, said arc groove having threads on a bottom thereof to engage with said screw rod;

a first spring fitted over an outer wall of said screw nut holder, said screw nut slot communicating with a first thread hole below said screw nut slot;

a thread bushing screwed in said first thread hole, a lower end of said first spring being fixed to said thread bushing, said screw nut holder running through a central hole of said thread bushing, said thread busing having an open slot on a bottom surface thereof, said open slot having a pin hole, an upper end of a connecting plate being inserted in said open slot, said connecting plate being fixed by a pin running through said pin hole, a lower end of said connecting plate having a slot, an eccentric shaft being mounted in said slot, and being connected with said operating handle; and an annular V-groove arranged in a circumferential direction on a lateral surface of said eccentric shaft, a pair of blind holes being arranged in a splayed shape in the V-groove, a stop pin being fixed in each of blind hole, a steel ball butting against an opening of the V-groove, said steel ball being fixed via a second spring to said front end of said fixed vice body.

3. The bench vice according to claim 1, wherein said means for controlling comprises:

a screw nut slot arranged on a front end of said fixed vice body at a side of said screw rod, said screw nut being accommodated in said screw nut slot;

a screw nut body near said screw rod;

a screw nut holder away from said screw rod, said screw nut body having an arc groove in an extension direction of said screw rod on an end of said arc groove near said screw rod, said arc groove having threads on a bottom thereof to engage with said screw rod;

a first spring fitted over an outer wall of said screw nut holder, said screw nut slot communicating with a first thread hole at an end of said screw nut slot away from said screw rod;

a thread bushing screwed in said first thread hole, an end of said first spring away from the screw rod being fixed in position by said thread bushing, said screw nut holder running through a central hole of said thread bushing, an end of said screw nut holder away from said screw rod being hinged via a pin shaft to said operating handle, wherein distance from hinge point to an edge of said operating handle at said end near said screw nut holder is not equal to distance from the hinge point to said edge at one side of said operating handle.

4. The bench vice according to claim 1, wherein said means for controlling comprises:

a screw nut slot arranged on a front end of said fixed vice body below said screw rod, said screw nut being accommodated in said screw nut slot;

a screw nut body at an upper end of said screw nut slot;

a screw nut holder at a lower end of said screw nut slot, said upper end of said screw nut body having an arc groove in an extension direction of said screw rod, said arc groove having threads on a bottom thereof to engage with said screw rod;

a first spring fitted over an outer wall of said screw nut holder, said screw nut slot communicating with a first thread hole below said screw nut slot;

a thread bushing screwed in said first thread hole, a lower end of said first spring being fixed to said thread bushing, said screw nut holder running through a central hole of said thread bushing and having a second thread hole extending upwards on said bottom surface, a screw being arranged in said second thread hole and engaged with inside threads of said second thread hole, said screw nut being connected with said operating handle, said operating handle being arranged on a horizontal rail and being rotatable on the rail, at least a part of a rail surface of the rail having a convex part.

5. The bench vice according to claim 1, wherein said means for controlling comprises:

a screw nut slot arranged on a front end of said fixed vice body below said screw rod, said screw nut being accommodated in said screw nut slot;

a screw nut body at an upper end of said screw nut slot;

a screw nut holder at a lower end of said screw nut slot, said upper end of said screw nut body having an arc groove in an extension direction of said screw rod, said arc groove having threads on a bottom of said arc groove to engage with said screw rod;

a first spring fitted over an outer wall of said screw nut holder, said screw nut slot communicating with a first thread hole below said screw nut slot;

a thread bushing screwed in said first thread hole, a lower end of said first spring being fixed to said thread bushing, said screw nut holder running through a central hole of said thread bushing and having a second thread hole extending upwards on a bottom surface of said screw nut holder, a screw being arranged in said second thread hole and engaged with inside threads of said second thread hole, said screw nut being connected with said operating handle via a lever, each end of said lever acting in a vertical direction.

* * * * *